United States Patent [19]

Vakil et al.

[11] 4,232,360

[45] Nov. 4, 1980

[54] HEAT RECOVERY HIGH INTENSITY DISCHARGE LAMP CONSTRUCTIONS

[75] Inventors: Himanshu B. Vakil; Seth D. Silverstein, both of Schenectady, N.Y.

[73] Assignee: General Electric Company, Schenectady, N.Y.

[21] Appl. No.: 868,531

[22] Filed: Jan. 11, 1978

[51] Int. Cl.[2] ..... F21V 29/00

[52] U.S. Cl. ..... 362/294; 362/218; 362/264

[58] Field of Search ..... 362/218, 294, 267, 264, 362/218, 373, 147; 313/22, 25, 35

[56] References Cited

U.S. PATENT DOCUMENTS

| | | | |
|---|---|---|---|
| 2,030,445 | 2/1936 | Gooskens | 362/264 X |
| 2,327,219 | 8/1943 | Rowland | 362/404 X |
| 3,037,110 | 5/1962 | Williams | 362/147 |
| 3,228,288 | 1/1966 | Marien | 362/147 X |
| 3,384,798 | 5/1968 | Schmidt | 313/184 |
| 3,573,452 | 4/1971 | Kenyon et al. | 362/294 |
| 3,609,335 | 9/1971 | Kelly | 362/147 |
| 3,626,424 | 12/1971 | Kahn | 362/294 X |
| 3,727,042 | 4/1973 | Evans et al. | 362/267 X |
| 3,843,879 | 10/1974 | Eddy | 362/218 |

OTHER PUBLICATIONS

Muller et al., *Testing & Performance of Heat Removal Troffers,* Ill. Eng'g, vol. 57, Dec. 1962, p. 793.

Fisher et al., *Heat Transfer—Luminaires,* Illuminating Eng'g, vol. 65, Apr. 1970, p. 185.

Quin et al., *Convective Transfer of—Loads,* Illuminating Eng'g, vol. 58, #1, Jan. 1962, p. 45.

Dunn et al., *Advanced Electrical Space Conditioning,* Illuminating Eng'g, vol. 59, #1, p. 43, Jan. 1964.

Fisher et al., *Some Factors Affecting Heat Transfer in Luminaires,* Illuminating Eng'g, vol. 60, Jan. 1965., p. 51.

*Primary Examiner*—Peter A. Nelson

*Attorney, Agent, or Firm*—Leo I. MaLossi; Joseph T. Cohen

[57] ABSTRACT

Composite high intensity discharge lamp constructions are described adapted for use in the recovery, in the form of heat, of energy in the non-visible frequencies emitted by such lamps. A transparent sleeve is disposed around and spaced from the lamp body being directly or indirectly connected thereto. Air passing between the sleeve and the lamp is brought into intimate heat transfer contact with both the outer surface of the lamp outer envelope and the inner surface of the sleeve.

11 Claims, 3 Drawing Figures

HEAT RECOVERY HIGH INTENSITY DISCHARGE LAMP CONSTRUCTIONS

BACKGROUND OF THE INVENTION

Electric lamps are efficient converters of electric power to heat energy. The energy is emitted as conduction-convection energy and as radiant energy. The latter includes infrared (IR), visible emission and ultraviolet (UV).

Good building design seeks to provide efficient utilization or dissipation of the lighting heat. Heat transfer luminaires for fluorescent lamps as well as heat transfer luminaires for incandescent lamps have been employed. Both air and water have been used as control mechanisms for the removal of lighting heat. The potential for heat transfer with high intensity discharge lamps in several prototype luminaires is described in the paper "Heat Transfer With High-Intensity Discharge Lamps and Luminaires" by W. S. Fisher and S. Weinstein (Illuminating Engineering, Vol. 65, April, 1970, Page 185).

In most of the instances in which air was employed as the medium for removing lighting heat and this air will have been deliberately or inherently moved over the surface of the lamp, primary reliance appears to have been placed upon contact between the air flow and the luminaire. In contrast thereto the instant invention focuses directly upon the lamp body for the recovery of heat therefrom as will be described hereinafter.

An application of prime interest for this invention is in the field of controlled environment agriculture, wherein high intensity discharge lamps are employed to provide all or part of the photosynthetic light required for the growth of plants. Thus, the thermal radiation emanating from a high intensity discharge lamp presents two major problems. In addition to the desired photosynthetic wavelengths, radiant thermal energy is also reflected downward by the lamp reflector onto the leaf surfaces. Since this additional thermal load can result in excess heating of the leaf, the thermal loading so imposed will often limit the intensity at which lamps in such establishments can be operated. A reduction in the thermal radiation reaching the plants at any given operating intensity is highly desirable, since this will permit an increase in the light intensity utilized, which in turn increases the intensity of the photosynthetic light to which the plants can be exposed with consequent advantages in growth rates. Also, a more general problem arises from the need to maintain a constant temperature within the controlled environment structure. The non-visible energy output from the lamp imposes a penalty (i.e., introduces an additional cooling load) without serving any useful purpose. It is, therefore, desirable to reduce the transfer of heat from the high intensity discharge lamps to the ambient (i.e., lamp surroundings) so that the cooling load handling capacity of the air conditioning can be reduced. At present, this high cooling duty is apparently a major problem even in colder climates, cooling being required during the period when the lights are operating and heating being required when the lights are turned off. The same basic need for reducing the air conditioning load imposed by lighting heat applies in industrial establishments, etc.

Thus, this art is in need of a relatively inexpensive lamp construction adapted to provide the capability for extracting as large a fraction of non-visible, thermal energy from high intensity discharge lamps at as high a temperature level as possible without significantly reducing the visible radiation.

DESCRIPTION OF THE INVENTION

The composite lamp constructions of this invention comprise a high intensity discharge lamp having in combination therewith a transparent sleeve extending around and along the outer envelope of the high intensity discharge lamp and being spaced therefrom in general coaxial relation therewith with a significant length of the transparent sleeve disposed opposite the lamp arc tube.

The sleeve and the outer surface of the lamp envelope define between them a primary heat exchange zone extending completely around the lamp envelope, the volume of this zone having a thickness (the distance from the lamp envelope to the transparent sleeve) in the range of from about 1 millimeter to about 2 centimeters and a length of at least about 10 percent of the length of the lamp arc tube, this defined zone being located opposite the arc tube.

The transparent sleeve of glass or heat resistant structural plastic may be rigidly mounted to the outer surface of the outer lamp envelope, or may be supported in the manner described in greater detail hereinbelow by providing sleeve connecting means affixed to the outer surface of the outer lamp envelope. Sleeve connecting means, when employed, may be formed in either of two configurations. In one configuration the sleeve connecting means will engage one end of the transparent sleeve. In the second configuration the sleeve connecting means will comprise a plenum chamber extending completely around a portion of the lamp outer envelope, the wall of the plenum chamber being affixed to and sealed to that end of the transparent sleeve adjacent thereto whereby the plenum chamber will be in flow communication with the defined zone described hereinabove. In the latter configuration, a separate opening is provided through the wall of the plenum chamber, spaced from the transparent sleeve, which opening is adapted for making a connection thereto.

With the exception of the latter configuration in which a plenum chamber provided as part of the lamp construction is in flow communication with the space between the inner surface of the transparent sleeve and the outer surface of the outer lamp envelope (and, thereby, with the defined primary heat exchange zone), when the composite lamp constructions of this invention are mounted by means of the lamp base thereof into receiving means therefor (e.g., in a luminaire), the one end of the transparent sleeve adjacent the lamp base is to project into a separate plenum chamber. In all configurations the opposite end of the sleeve is disposed so that the space between lamp and sleeve is in flow communication with the lamp surroundings.

The invention by which the composite lamp construction described and claimed herein is employed to place the lamp surroundings in flow communication with some removed preselected volume is described and claimed in U.S. Patent Application Ser. No. 868,527—Himanshu B. Vakil and Seth D. Silverstein assigned to the assignee of the instant invention and filed Jan. 11, 1978. As described therein, the preselected volume is placed in communication with the lamp surroundings via the interior of the plenum chamber and the space between the outer surface of the lamp and the inner surface of the sleeve. The aforementioned patent application is incorporated by reference.

BRIEF DESCRIPTION OF THE DRAWING

The subject matter of the instant invention for which protection is sought is presented in the appended claims. The following detailed description sets forth the manner and process of making and using the invention and the accompanying drawing forms part of the overall description for schematically illustrating the invention and the best mode.

The view shown in FIG. 1 schematically illustrates in section one embodiment of the composite lamp construction of this invention installed in a commercially available luminaire (upper portion only shown) with a plenum chamber construction retrofitted therein as described in Ser. No. 868,527.

DETAILED DESCRIPTION OF THE MANNER AND PROCESS OF MAKING AND USING THE INVENTION

Exemplary high intensity discharge lamp structures useful in the composite lamp constructions of this invention are disclosed in the following U.S. patents incorporated by reference: U.S. Pat. No. 2,166,951—Germer; U.S. Pat. No. 2,660,692—St. Louis et al.; U.S. Pat. No. 3,384,798—Schmidt; U.S. Pat. No. 3,521,110—Johnson; U.S. Pat. No. 3,609,437—Tol et al.; U.S. Pat. No. 3,855,494—Plagge; and U.S. Pat. No. 3,935,495—Scott,, Jr. et al. The high intensity discharge lamps particularly useful in the preparation of composite lamp constructions according to this invention are those in which the temperature of the outer surface (i.e., outer jacket or outer envelope) of such lamps will be at temperatures of about 300° C. or higher during lamp operation, however, high intensity discharge lamps can be successfully employed, which operate with jacket temperatures as low as about 70° C.

As has been indicated hereinabove, the preferred dimension for the distance from the outer surface of the lamp envelope to the inner surface of the transparent sleeve in the primary heat exchange zone is in the range of from about 1 mm. to about 2 cm. The optimum range of values for this dimension is in the range of from about 3 mm. to about 7 mm.

Figure 1:
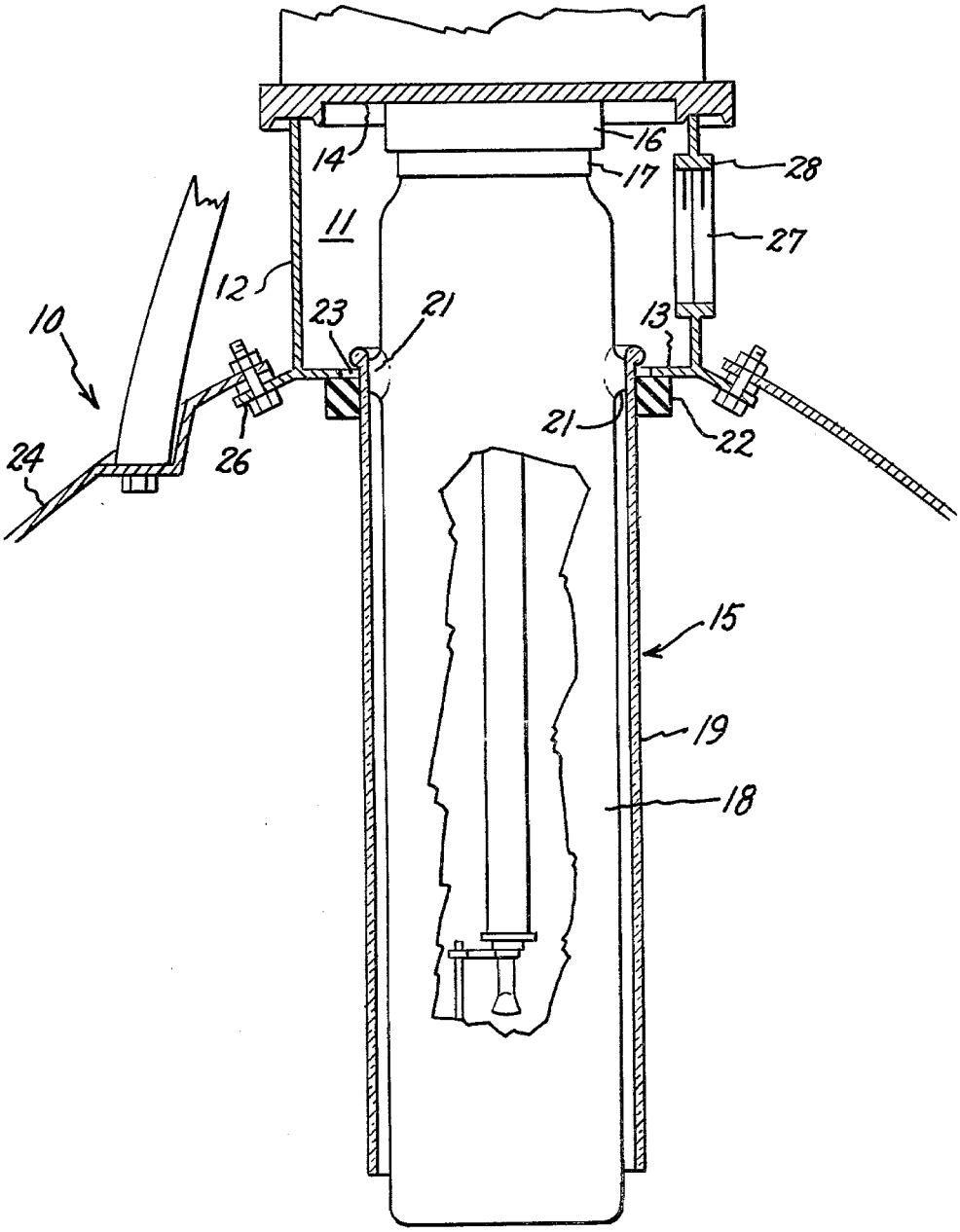

FIG. 1 schematically illustrates a commercial luminaire 10 retrofitted to provide the plenum chamber 11 defined by side wall 12 and lower wall 13. Sidewall 12 is shown interfitted with housing 14. The composite lamp structure 15 constructed in accordance with this invention is engaged with and depends from lamp receiving means, or socket, 16 by mounting means in the form of conventional screw base 17. As shown, composite lamp construction 15 comprises high intensity discharge lamp 18 with transparent sleeve 19 affixed thereto.

Preferably both the outer envelope of lamp 18 and sleeve 19 are in substantial coaxial alignment and both are made of glass. These elements are rigidly interconnected by means of a plurality of discrete glass posts 21. Posts 21 are spaced from each other around the annular opening and span the distance from sleeve 19 to the outer envelope of lamp 18. The spaces between adjacent posts 21 together with the spacing between sleeve 19 and lamp 18 provide sufficient open cross-sectional area to insure the requisite flow communication from end-to-end of sleeve 19.

As lamp base 17 is screwed into socket 16, annular seal 22 snugly fitted around lamp 18 is urged into contact with the lower wall 13 of plenum chamber 11 to close off opening 23.

Retrofitted luminaire 10 would be one of a large number disposed within a building, not shown, such as a horticultural enclosure or an industrial establishment. Reflector 24 is provided with a hole at the top thereof to enable the insertion of the retrofitting unit to define plenum chamber 11. Mounting flange 26 enables the retention of wall 12 in the location shown in order to properly define plenum chamber 11 in cooperation with housing 14. When assembled in the manner shown, the space between the outer surface of lamp 18 and the inner surface of sleeve 19 is placed into flow communication with plenum 11. Sleeve 19 is spaced from the outer surface of lamp 18 along the coextensive lengths thereof. In this manner, plenum 11 is placed in flow communication with the surroundings of lamp 18.

Opening 27 to plenum 11 extends through collar 28 formed in the plenum wall and is interconnected with a conduit (not shown) extending to a manifold (not shown). A series of such conduits would interconnect a bank of plenum chambers 11 (defined in their respective luminaires) with the manifold. The manifold in turn would be placed in flow communication with appropriate ducting leading to some preselected volume (not shown) at a distance from the bank of luminaires 10.

Figure 2:
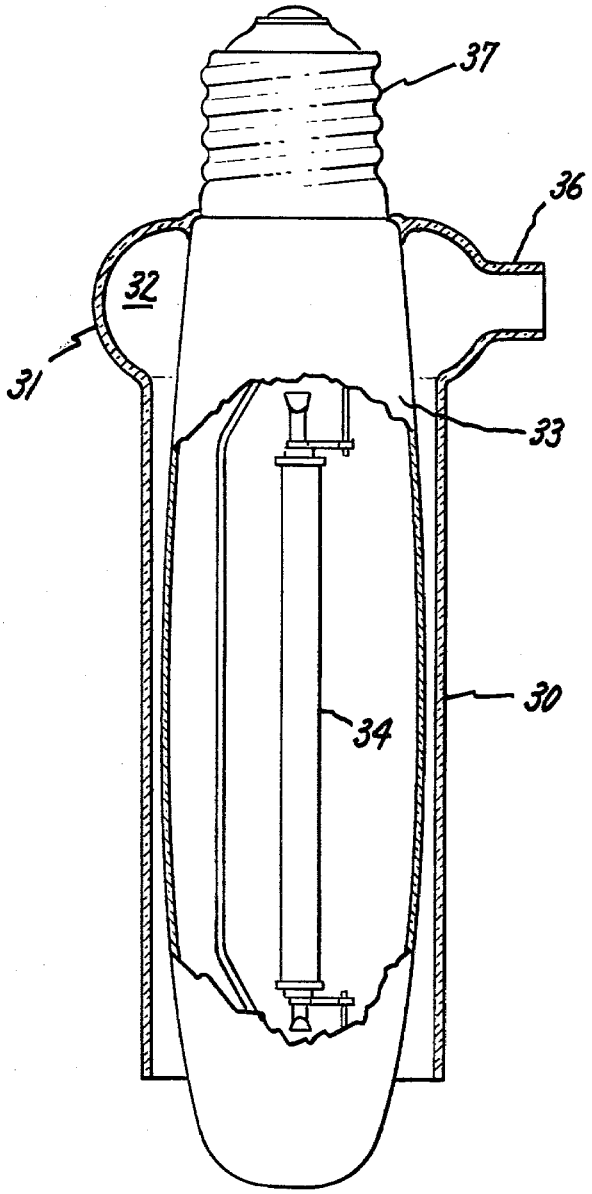
FIG. 2 is a sectional view of a composite high intensity discharge lamp construction in accordance with the instant invention wherein the transparent sleeve is connected to the lamp outer envelope by means of intermediate construction defining a plenum chamber in flow communication with the space between the transparent sleeve and the outer surface of the lamp outer envelope and FIG. 3 is a sectional view similar to FIG. 1 showing the composite lamp construction of this invention wherein the transparent sleeve is supported from the lamp outer envelope by connecting means affixed to such envelope.

Retrofitting of commercially available luminaires can be avoided by utilizing the lamp construction configuration shown in FIG. 2. Transparent sleeve 30 is formed integral with the wall area 31 defining plenum chamber 32. This plenum/transparent sleeve unitary construction is bonded to the outer envelope of lamp 33 to sealingly interconnect these structures in a rigid manner whereby the integrally formed plenum/transparent sleeve construction is supported by lamp 33 with the requisite spacing therebetween to define a zone extending completely around the lamp envelope as described hereinabove. This zone is located opposite the lamp arc tube 34.

Opening 36 is provided for flow communication with plenum chamber 32 to enable the removal of heated air therefrom and for the interfitting of a conduit (not shown) thereto in an appropriate manner, when the lamp structure has been mounted in place in a luminaire (not shown) by means of lamp base 37.

Figure 3:
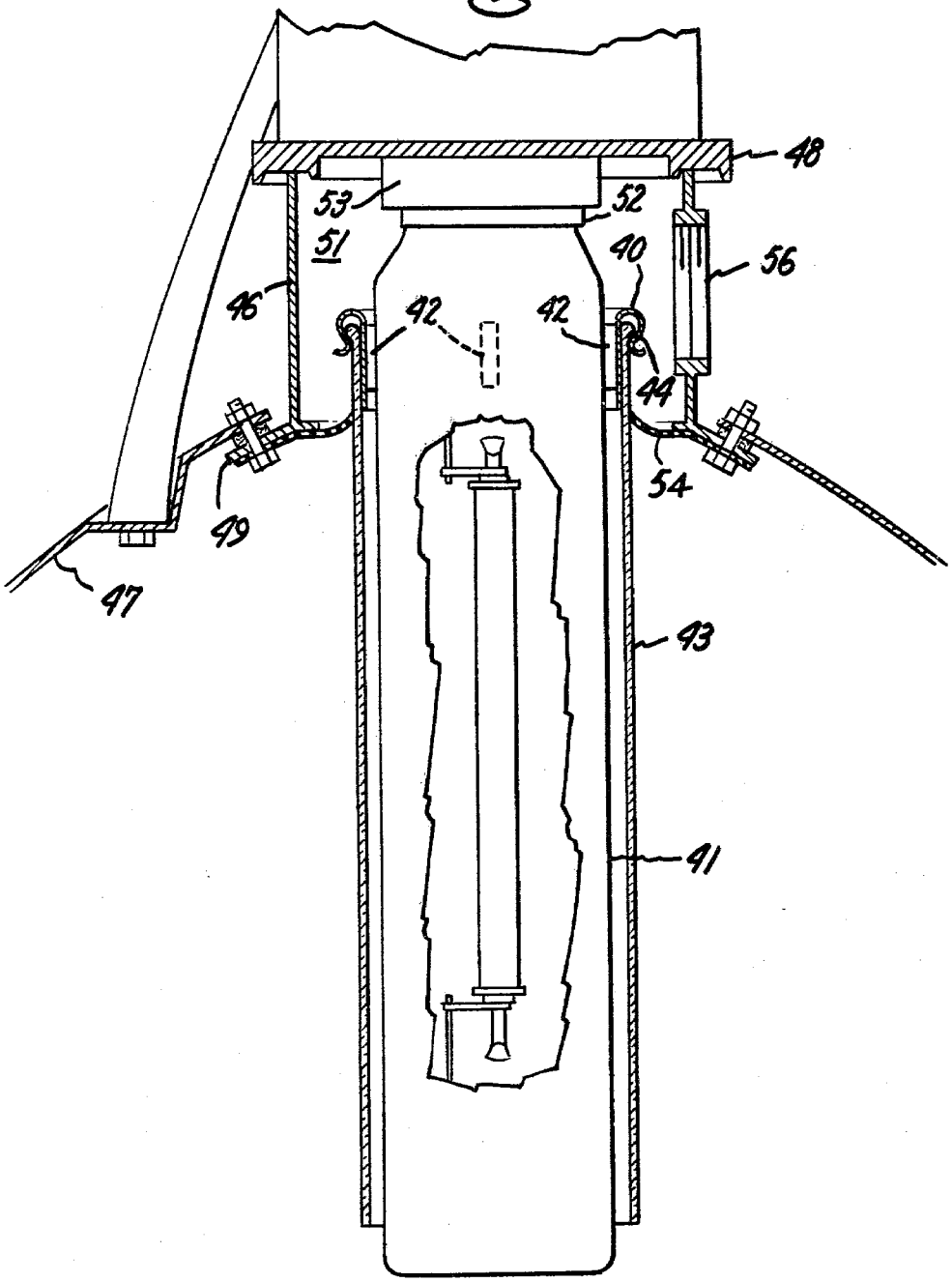

Still another means for connecting a transparent sleeve to a high intensity lamp is shown in FIG. 3. Thus, annular spring metal clip 40 somewhat larger in diameter than the outer diameter of lamp 41 is affixed to the outer envelope by means of several spaced pads 42 bonded both to metal clip 40 and to the outer surface of lamp 41. When affixed in place, clip 40 will serve to interconnect transparent sleeve 43 (optionally provided with a flare at the lower end thereof) to lamp 41. Preferably the rim at the end of transparent sleeve 42 so engaged is enlarged sufficiently such that when this end of sleeve 42 is forced into clip 40, spring end 44 of clip 40 can positively secure sleeve 43 in position spaced from the outer surface of lamp 41.

This composite lamp construction of FIG. 3 would be used in the retrofitting of a commercially available luminaire in the general manner described in connection with the construction shown in FIG. 1. Thus, a plenum-defining wall structure 46 is inserted through the hole at the top of reflector 47 to engage the underside of housing 48. This unit is held in place by fasteners affixing mounting flange 49 to the reflector structure as shown. In this position, wall structure 46 and housing 48 define the requisite plenum chamber 51.

Clip 40 is affixed to lamp 41 near lamp base 52 so that, when the composite (lamp, clip and sleeve) is mounted by the interfitting of lamp base 52 in lamp receiving means 53, the upper end of sleeve 43 will project far enough into plenum chamber 51 to insure adequate engagement between the outer surface of sleeve 43 and flexible annular gasket 54. At the same time, this arrangement places the ambient around the lower end of sleeve 43 in flow communication with plenum 51 via the space between the outer surface of lamp 41 and the inner surface of sleeve 43 and the open spaces defined between clip 40, the outer surface of lamp 41 and the pads 42. Flow communication of plenum 51 with some preselected volume distant therefrom is provided via opening 56, conduit means (not shown) affixed thereto and manifold means (not shown).

In all instances in the composite lamp constructions of this invention spacing is to be assured between the transparent sleeve and the outer surface of the lamp envelope such that these elements define at some location therebetween a zone extending completely around the lamp envelope, which will be in flow communication with the surroundings of the lamp and with the plenum. This zone is to occupy a volume in the general form of a solid of revolution having a thickness in the range of from about 1 mm. to about 2 cm. and a length of at least 10 percent of the length of the lamp arc tube, the zone so defined being located opposite the arc tube.

In utilizing the composite lamp constructions of this invention, ambient air is drawn into the space between lamp and sleeve, through the primary heat exchange zone and through the plenum for whatever use is to be made of the heated air. The dimensions of the primary heat exchange zone result in the creation of a local flow rate of air close to the surface of the lamp such that a significant amount of energy is absorbed in a relatively small air flow due to the large convective heat transfer coefficient so provided. Further, when the sleeve is made of a material, such as glass, which functions as a radiation shield for thermal radiation, as the air flow traverses the space between lamp and sleeve, it simultaneously receives heat outwardly from the outer surface of the lamp and inwardly from the sleeve.

Analysis has shown that with composite constructions in which the spacing between the sleeve and the lamp have been optimized, flows in the range of from about 8 grams/second to about 20 grams/second at temperatures in excess of 150° F. are readily obtainable.

Distribution of the heated air so obtained from the plenum is described in the aforementioned application Ser. No. 868,527.

Best Mode Contemplated

The best mode of this invention for the recovery of heat energy in the non-visible frequencies is the composite lamp/sleeve arrangement shown in FIG. 1. A substantially uniform spacing (optimized) of between about 3 mm. and about 7 mm. would be provided between a 1000-watt LUCALOX ® high pressure sodium discharge lamp and a cylindrical sleeve of borosilicate glass. The thickness of the glass sleeve would be in the range of from about 1 to 2 mm.

What we claim as new and desire to secure by Letters Patent of the United States is:

1. A composite high intensity discharge lamp structure adapted for the recovery of heat emitted by such lamps comprising in combination a transparent longitudinally extending envelope formed with a closed end, means for mounting said lamp affixed to and closing said envelope at the opposite end theeof, arc tube support means mounted within said envelope, an arc tube affixed thereto extending generally axially of said envelope and a transparent sleeve mounted outside of and connected to said envelope, said sleeve being open at both ends and being spaced from said envelope along the coextensive lengths thereof, the volume between said sleeve and said envelope defining at least in part a zone providing a large convective heat transfer coefficient extending around said envelope opposite said arc tube, said zone having a thickness in the range of between 1 mm. and 2 cm. and a length equal to at least about 10 percent of the length of said arc tube.

2. The high intensity discharge lamp structure as recited in claim 1 wherein the sleeve is substantially coaxial with the envelope.

3. The high intensity discharge lamp structure as recited in claim 2 wherein both the envelope and the sleeve are formed as solids of revolution.

4. The high intensity discharge lamp structure as recited in claim 3 wherein both the envelope and the sleeve are in the general shape of hollow right circular cylinders.

5. The high intensity discharge lamp structure as recited in claim 1 wherein the sleeve is made of glass.

6. The high intensity discharge lamp structure as recited in claim 5 wherein the sleeve is made of pyrex.

7. The high intensity discharge lamp structure as recited in claim 1 wherein the sleeve is made of heat resistant structural plastic.

8. The high intensity discharge lamp structure as recited in claim 1 wherein the transparent sleeve is rigidly affixed to the lamp envelope.

9. The high intensity discharge lamp structure as recited in claim 1 with means for connecting the sleeve to the lamp envelope affixed to said envelope intermediate said envelope and said sleeve.

10. The high intensity discharge lamp structure as recited in claim 9 wherein the transparent sleeve is connected to an enlarged chamber at the end thereof adjacent the lamp mounting means, said chamber being in flow communication with the space between said sleeve and the envelope, said chamber having an opening in the wall thereof removed from said space through which said space is placed in flow communication via said chamber with a volume exterior to said chamber, said chamber wall being affixed to said envelope.

11. The high intensity discharge lamp structure as recited in claim 9 wherein the means for connecting the sleeve to the lamp envelope comprises a metal clip rigidly affixed to the outer surface of said envelope.

* * * * *